US009203190B2

(12) United States Patent
Hamai et al.

(10) Patent No.: US 9,203,190 B2
(45) Date of Patent: Dec. 1, 2015

(54) LOCK STRUCTURE OF CONNECTOR

(75) Inventors: Tsuyoshi Hamai, Makinohara (JP); Hiromasa Kubota, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/236,342

(22) PCT Filed: Sep. 6, 2012

(86) PCT No.: PCT/JP2012/073385

§ 371 (c)(1),
(2), (4) Date: Jan. 31, 2014

(87) PCT Pub. No.: WO2013/035886

PCT Pub. Date: Mar. 14, 2013

(65) Prior Publication Data

US 2014/0179146 A1 Jun. 26, 2014

(30) Foreign Application Priority Data

Sep. 7, 2011 (JP) ..... 2011-195370

(51) Int. Cl.
*H01R 13/639* (2006.01)
*H01R 13/627* (2006.01)

(52) U.S. Cl.
CPC ..... *H01R 13/639* (2013.01); *H01R 13/6272* (2013.01)

(58) Field of Classification Search
CPC ..... H01R 13/6275; H01R 13/6272; H01R 13/6273
See application file for complete search history.

(56) References Cited

U.S. PATENT DOCUMENTS

| | | | | |
|---|---|---|---|---|
| 8,758,038 | B2 * | 6/2014 | Kubo et al. | 439/358 |
| 8,882,528 | B2 * | 11/2014 | Sasho et al. | 439/358 |
| 2001/0035652 | A1 | 11/2001 | Wada et al. | |
| 2003/0087544 | A1 | 5/2003 | Nogawa et al. | |
| 2006/0105611 | A1 | 5/2006 | Toyoda | |

FOREIGN PATENT DOCUMENTS

| | | | |
|---|---|---|---|
| CN | 1417891 | A | 5/2003 |
| CN | 1577994 | A | 2/2005 |
| CN | 1773782 | A | 5/2006 |

(Continued)

OTHER PUBLICATIONS

Office Action dated Nov. 26, 2014 issued by Korean Intellectual Property Office in counterpart Korean Application No. 10-2014-7004876.

(Continued)

*Primary Examiner* — Gary Paumen
(74) *Attorney, Agent, or Firm* — Sughrue Mion, PLLC

(57) ABSTRACT

A lock structure of a connector includes a flexible lock arm, a lock engaging part and a releasing lever part. The flexible lock arm fixed to the second connector housing at a base end portion thereof is extended in a fitting direction of the connector. The lock engaging part provided at a distal end portion of the flexible lock arm is configured to be locked with a locking part provided in the first connector housing. The releasing lever part connected to the lock engaging part is extended along the flexible lock arm, and is configured to be rotated together with the lock engaging part around a pivot which is movable while releasing the lock. A thickness of the flexible rock arm is gradually decreased from the base end portion to the lock engaging part.

7 Claims, 4 Drawing Sheets

(56) References Cited

FOREIGN PATENT DOCUMENTS

| | | | |
|---|---|---|---|
| DE | 4243268 | A1 | 6/1994 |
| EP | 0 933 835 | A2 | 8/1999 |
| EP | 0 933 835 | A3 | 8/1999 |
| EP | 0933835 | A2 | 8/1999 |
| JP | 11-260456 | A | 9/1999 |
| JP | 2001250636 | A | 9/2001 |
| JP | 2003308925 | A | 10/2003 |
| JP | 2005-032509 | A | 2/2005 |

OTHER PUBLICATIONS

Office Action dated Jul. 9, 2015, issued by the State Intellectual Property Office of the People's Republic of China in counterpart Chinese Application No. 201280043636.3.

Office Action dated May 7, 2015 issued by the Japanese Patent Office in counterpart Japanese Patent Application No. 2011-195370.

International Search Report, dated for Dec. 12, 2012, issued by the International Searching Authority in counterpart International Application No. PCT/JP2012/073385.

Written Opinion, dated Dec. 12, 2012, issued by the International Searching Authority in counterpart International Application No. PCT/JP2012/073385.

Communication dated Jun. 17, 2015 issued by the Korean Intellectual Property Office in counterpart Korean Patent Application No. 10-2014-7004876.

Office Action dated Sep. 15, 2015, issued by the Japanese Intellectual Property Office in counterpart Japanese Application No. 2011-195370.

* cited by examiner

LOCK STRUCTURE OF CONNECTOR

TECHNICAL FIELD

The present invention is related to a lock structure of a connector.

BACKGROUND ART

As a conventional lock structure of a connector, such a lock structure as shown in FIGS. 5 and 6 has been disclosed (see PTL 1). FIG. 5 is a perspective view of an entirety of a lock part, and FIG. 6 is a partial sectional view showing the lock part in a female connector housing.

Both side faces of a lock part 105 in a female connector housing 101 are formed in a shape of a half arrow head extending in a fitting direction, and a releasing lever part 107 is formed of these side faces. In a front end part (an end part at a forehand side in FIG. 5) of the releasing lever part 107, there is formed a front edge part 111 so as to extend over an entire width in a lateral direction. Two lock arms 109 in a plate-like shape are extended backward substantially horizontally from the front end part 111. As shown in FIG. 6, respective back end parts (at a deep side in FIG. 5) of the two lock arms 109 are bent downward, and connected to a horizontal wall part 101*a* of the female connector housing 101 to be formed into fixed ends 109*a*.

An intermediate part of the front edge part 111 between the two lock arms 109 which are spaced in the lateral direction is formed as a latch part (a lock engaging part) 111*a* for locking a locking part of a male connector housing (not shown).

On the other hand, a lower end part of the releasing lever part 107 is at the substantially same position in the fitting direction as the fixed ends 109*a* in the back end parts of the lock arms 109, and constitutes a supporting part 107*a* which performs as a pivot of rotation of the releasing lever part 107 at a time of lock releasing operation. In a state where the female connector housing 101 exists by itself, there is a gap between this supporting part 107*a* and the horizontal wall part 101*a* of the female connector housing 101 (See FIG. 6).

A flat face part of the releasing lever part 107 which is spread backward than the supporting part 107*a* over the entire width constitutes a finger hooking part 117.

According to the lock structure as described above, the releasing lever part 107 for releasing the locked condition between the male connector housing and the female connector housing 101, utilizing a lever action, is provided so as to be continued from the latch part 111*a* of the lock arms 109. Therefore, when the latch part 111*a* of the lock arms 109 are deformed by a predetermined amount, occurrence of an excessive stress to be exerted on the fixed ends 109*a* of the lock arms 109 can be prevented. As the results, the lock arms 109 may be broken.

CITATION LIST

Patent Literature

[PTL 1] JP-A-2001-250636

SUMMARY OF INVENTION

Technical Problem

In a tendency of downsizing the connector, it is requested that the lock structure of the connector is also downsized. For this purpose, it is necessary to make the lock arms 109 shorter in length. However, in case where the lock arms 109 are simply made shorter, rigidity of the lock arms 109 is enhanced, and the lock arms 109 are hardly deformed in a curve.

When a force for displacing the latch part 111*a* upward is applied to the lock arms 109, on occasion of locking or unlocking, there is such possibility that the stress may be concentrated on the fixed ends 109*a*, resulting in breakdown of the lock arms 109.

It is therefore one advantageous aspect of the present invention to provide a lock structure of a connector in which flexibility of lock arms can be maintained, even in case where the lock arms are made shorter in length, while the lock structure itself can be downsized according to a request for downsizing the connector.

Solution to Problem

According to one advantage of the invention, there is provided a lock structure of a connector, in which a first connector housing and a second connector housing to be engaged with each other are locked in a releasable manner, the lock structure comprising:

a flexible lock arm, fixed to a wall part of the second connector housing at a base end portion of the flexible lock arm, and extended in a fitting direction in which the second connector housing is fitted with the first connector housing;

a lock engaging part, provided at a distal end portion of the flexible lock arm, and configured to be locked with a locking part provided in the first connector housing; and a releasing lever part, connected to the lock engaging part at one end portion of the releasing lever part, extended along the flexible lock arm, and configured to be rotated together with the lock engaging part around a pivot which is movable while releasing the lock, wherein a thickness of the flexible rock arm is gradually decreased from the base end portion to the lock engaging part.

Advantageous Effects of Invention

According to the lock structure of the connector having the above described structure, when the first and second connector housings are engaged with each other, a member for resisting displacement of the lock engaging part is only the lock arm of a cantilever type. Moreover, the lock arm is formed in such a manner the thickness of the lock arm in the cross sectional plane is gradually decreased from the base end portion to the lock engaging part. Therefore, even in case where a total length of the lock arm is made shorter, the distal end side of the lock arm can be deformed in a curve, and stress exerted on the base end portion can be dispersed. As the results, it is possible to prevent breakdown of the lock arm.

At the time of the lock releasing operation, the locked state is released, by rotating the lock engaging part together with the releasing lever part around the pivot. On this occasion, because a position of the pivot of the rotation can be displaced, the lock engaging part is rotated without resistance, and the lock arm which is deformed will not receive an excessive load. As the results, a problem of being short of rigidity will not occur.

According to the lock structure of the connector according to the invention, it is possible to provide the lock structure of the connector in which flexibility of the lock arm can be maintained, even in case where the lock arms are made shorter in length, while the lock structure itself can be downsized according to a request for downsizing the connector.

DESCRIPTION OF EMBODIMENTS

Figure 1:
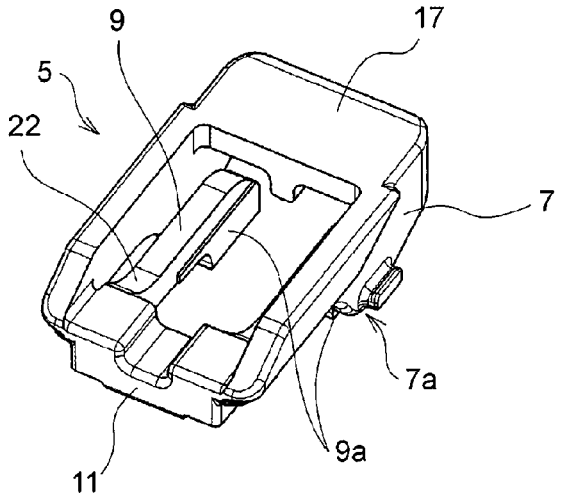
FIG. 1 is a perspective view of an entirety of a lock part in a lock structure of a connector in an embodiment according to the invention.

Referring to the drawings, a lock structure of a connector in an embodiment according to the invention will be described in detail.

As shown in FIG. 1, both side faces of a lock part 5 of a female connector housing (a second connector housing) 1 in the embodiment are formed in a shape of a half arrow head extending in a fitting direction (a longitudinal direction of the lock part 5), and a releasing lever part 7 is formed of these side faces. A front edge part 11 extending over an entire width in a lateral direction is formed in a front end part (an end part at a forehand side in FIG. 1), which is one side end of the releasing lever part 7.

Figure 2:
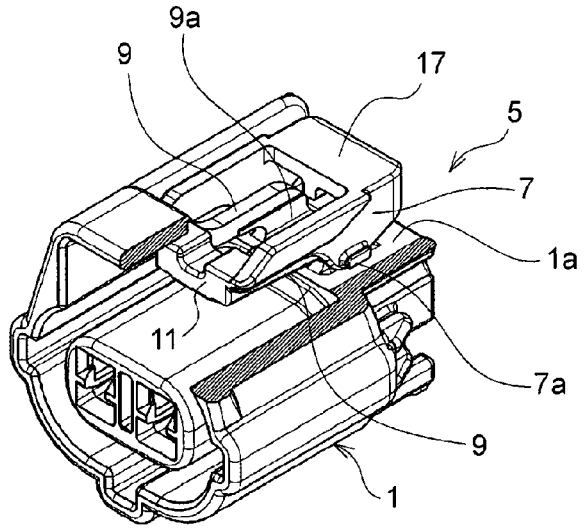
FIG. 2 is a partly broken perspective view showing a second connector housing in the embodiment according to the invention.

Two lock arms 9 in a plate-like shape are extended backward substantially horizontally from the front edge part 11. As shown in FIG. 2, respective back end parts (at a deep side in FIG. 1) of the two lock arms 9 are bent downward, and formed into base end portions 9*a* which are connected to a horizontal wall part (a wall part) 1*a* of the female connector housing 1.

The front edge part 11 at an intermediate between the two lock arms 9 which are spaced in the lateral direction is provided with a lock engaging part 20 to be locked to a locking part 13 of a male connector housing (a first connector housing) 3 (See FIG. 4), so as to project from a face thereof (a lower face in FIG. 3) opposed to the female connector housing 1.

Each of the lock arms 9 is formed in such a manner that a thickness H2 in a cross sectional plane near the lock engaging part 20 is smaller than a thickness H1 in a cross sectional plane of the base end portion 9*a*, and the thickness of the lock arm 9 in the cross sectional plane is gradually decreased from the base end portion 9*a* to the lock engaging part 20.

Figure 3:
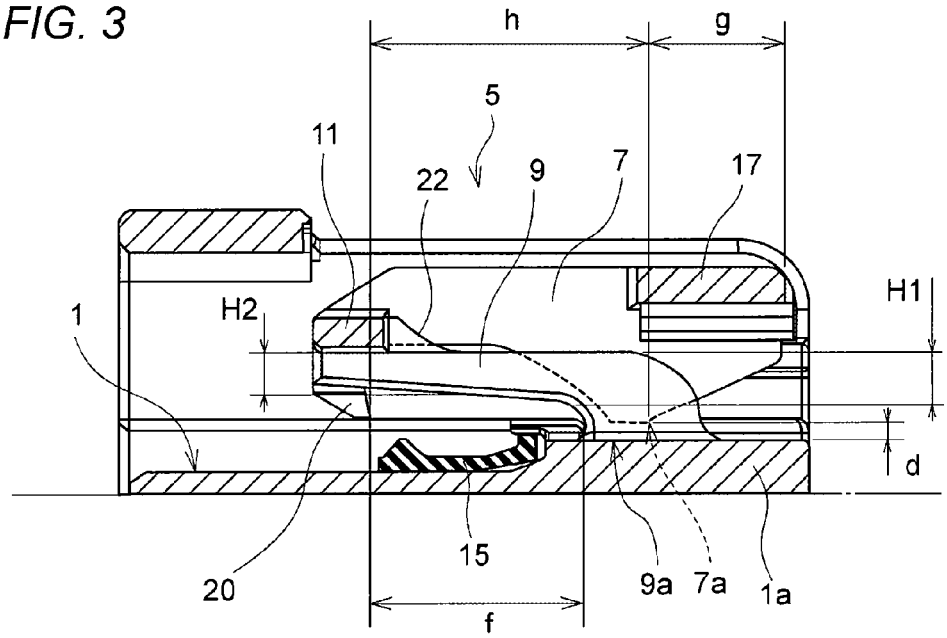
FIG. 3 is a partial sectional view showing the lock part of the second connector housing as shown in FIG. 2.

Sign f represents an overhanging amount of the lock arm 9 from the base end portion 9*a* to the lock engaging part 20 (See FIG. 3). Reference numeral 15 in FIG. 3 represents a seal member.

On the other hand, a lower end part of the releasing lever part 7 is at the substantially same position in the fitting direction as the base end portion 9*a* at a back end side of the lock arm 9, and constitutes a supporting part 7*a* which functions as a pivot of rotation of the releasing lever part 7 at a time of lock releasing operation, which will be described below. In a state where the female connector housing 1 exists by itself, there is a gap d between this supporting part 7*a* and the horizontal wall part 1*a* of the female connector housing 1 (See FIG. 3).

A flat face of the releasing lever part 7 which is spread backward than the supporting part 7*a* over the entire width constitutes a finger hooking part 17 for the lock releasing operation. Sign g represents a distance from the supporting part 7*a* to a back end of the finger hooking part 17, and sign h represents a distance from the supporting part 7*a* to the lock engaging part 20.

Then, operation of the lock part 5 when the two connector housings 1 and 3 are engaged and disengaged (at the time of the lock releasing operation) will be described referring to FIGS. 4A and 4B.

Figure 4A:
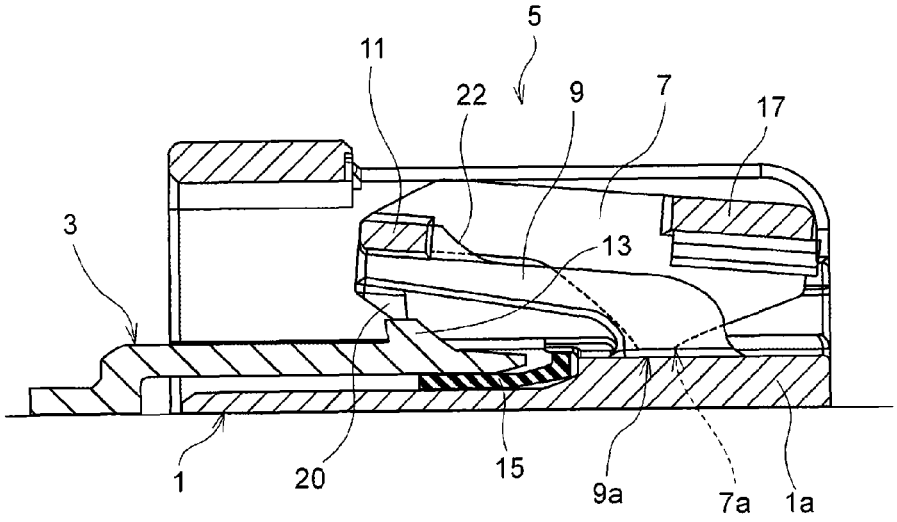
FIG. 4A is a partial sectional view showing operation of the first and second connector housings in the embodiment according to the invention, in a state where the lock part is not locked to a locking part.

FIG. 4A shows a state just before the male connector housing 3 is locked to the female connector housing 1, while they are engaged with each other. When the engagement between the two connector housings 1, 3 proceeds, the locking part 13 of the male connector housing 3 comes into contact with the lock engaging part 20 of the lock arm 9, and pushes up the lock engaging part 20. On this occasion, the lock arm 9 receives an upward bending moment around the base end portion 9*a* at the back side. A radius of action of a pushup force is the overhanging amount f.

The lock arm 9 in this embodiment is formed in such a manner that the thickness thereof in the cross sectional plane is gradually decreased from the base end portion 9*a* to the lock engaging part 20. The cross sectional plane in which the thickness is defined is a plane in which the lock arm 9 is deformed. Therefore, even in case where a total length of the arm is made smaller, a distal end side of the lock arm 9 can be deformed in a curve, and an angle of flexure near the base end portion 9*a* of the lock arm 9, when the lock engaging part 20 is pushed up, can be made smaller. As the results, it is possible to prevent breakdown of the lock arm 9, by dispersing the stress to be exerted on the base end portion 9*a*.

As the lock arm 9 is deformed and bent, the supporting part 7*a* of the releasing lever part 7 which is continued from the front edge part 11 (the lock engaging part 20) moves downward, and comes into contact with the horizontal wall part 1*a* of the female connector housing 1, making the gap d zero. When the locking part 13 has passed the lock engaging part 20, the lock arm 9 which has been pushed up by the lock engaging part 20 and deformed is restored to its original state, and thus, the male connector housing 3 is locked. In the locked state, the gap d of the supporting part 7*a* is recovered. Although a posture of the releasing lever part 7 changes while the locked state is achieved, this change in posture can be freely performed, without being affected by the other members.

Figure 4B:
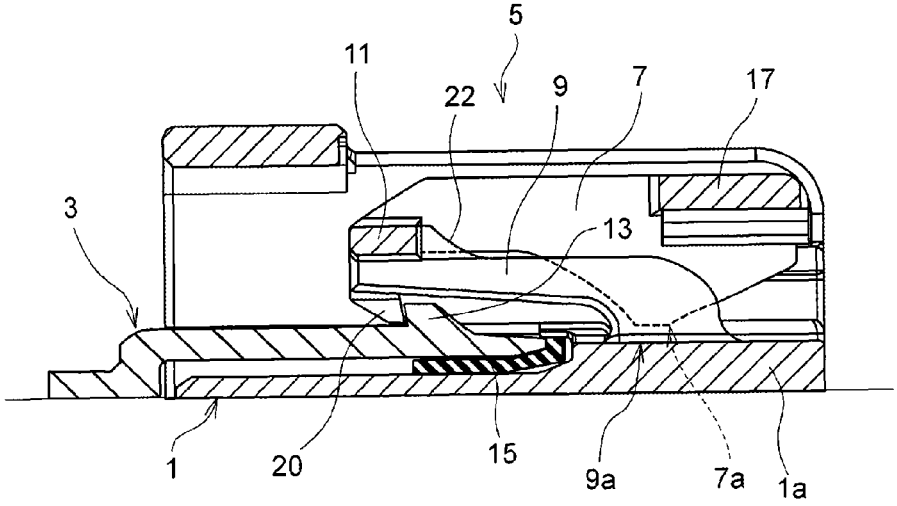
FIG. 4B is a partial sectional view showing the operation of the first and second connector housings in the embodiment according to the invention, in a state where the lock part is locked to the locking part.
Figure 5:
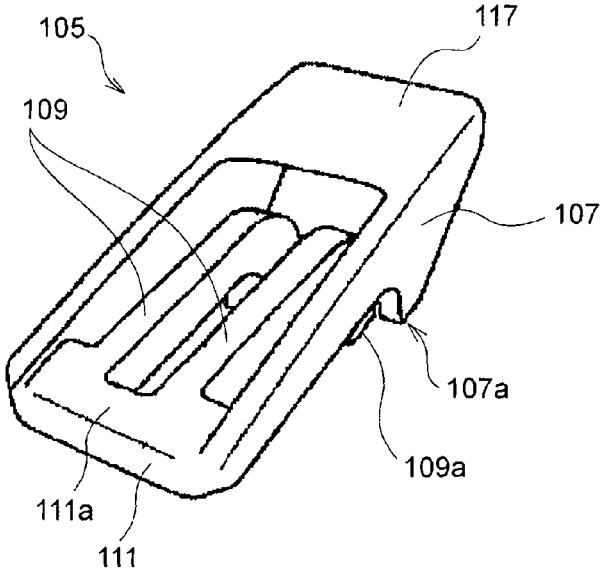
FIG. 5 is a perspective view of an entirety of a conventional lock part.
Figure 6:
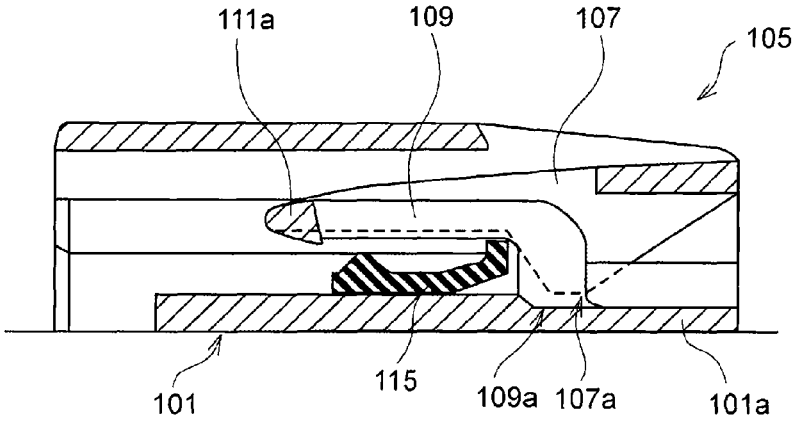
FIG. 6 is a partial sectional view showing the conventional lock part in a female connector housing.

FIG. 4B shows a state where the lock between the two connector housings 1 and 3 is released. In order to release the lock, the finger hooking part 17 at the back end of the releasing lever part 7 is pushed downward. With this pushdown operation, the supporting part 7*a* of the releasing lever part 7 is moved downward and brought into contact with the horizontal wall part 1*a* of the female connector housing 1. Even in case where the finger hooking part 17 is further pushed downward after the contact, a lifting moment to be exerted on the lock engaging part 20 is equal to a moment of pushing down the finger hooking part 17 around the supporting part 7*a*, due to a lever action. Because the radius h of the rotation of the lock engaging part 20 around the supporting part 7*a* is set to be larger than the radius g of the rotation at a side of the pushdown operation, the force for lifting the lock engaging part 20 is smaller than the force for pushing down the finger hooking part 17. Therefore, there is no such anxiety that the lock arm 9 may be short of rigidity.

The cross sectional plane in which the thickness of the lock arm 9 is defined is a plane in which the finger hooking part 17 moves downward by being pushed.

As described hereinabove, according to the embodiment, as different from the prior art, the releasing lever part 7 for releasing the locked state between the male and female connector housings 3 and 1, utilizing the lever action, is provided in a manner continued from the lock engaging part 20 of the lock arm 9, and the thickness of the lock arm 9 in the cross sectional plane is so formed as to be gradually decreased from the base end portion 9*a* to the lock engaging part 20. Therefore, even in case where the total length of the lock arm is made smaller, the distal end side of the lock arm 9 can be deformed in a curve, and the stress exerted on the base end portion 9*a* can be dispersed. As the results, it is possible to prevent breakdown of the lock arm 9.

In the lock part 5 in the above described embodiment, an R part 22 is formed in an upper part at the distal end side of the lock arm 9 which is extended backward from the front edge part 11, and therefore, the thickness of the lock arm 9 in the cross sectional plane at the distal end side is larger than the thickness H2 in the cross sectional plane near the lock engaging part 20. However, the thickness of the lock arm 9 in the cross sectional plane is so formed as to be gradually decreased from the base end portion 9*a* to the lock engaging part 20, as described above, and hence, the distal end side of the lock arm 9 can be sufficiently deformed in a curve.

It is of course possible to appropriately modify a shape of the lock arm 9 at the distal end side, so that the thickness of the lock arm 9 in the cross sectional plane may be gradually decreased from the base end portion 9*a* to the lock engaging part 20.

The lock structure of the connector according to this invention is not limited to the above described embodiment, but various modifications, improvements, and so on can be appropriately made. Further, materials, shapes, sizes, numbers of the respective constituent elements in the above described embodiment are not limited, but optional, provided that the invention can be achieved.

The present application is based on Japanese Patent Application No. 2011-195370 filed on Sep. 7, 2011, the contents of which are incorporated herein by way of reference.

INDUSTRIAL APPLICABILITY

According to a lock structure of a connector of the invention, flexibility of lock arms can be maintained, even in case where the lock arms are made shorter in length, while the lock structure itself can be downsized according to a request for downsizing the connector.

REFERENCE SIGNS LIST

1 Female connector housing (second connector housing)
1*a* Horizontal wall part (wall part)
3 Male connector housing (first connector housing)
5 Lock part
7 Releasing lever part
7*a* Supporting part (pivot)
9 Lock arm
9*a* Base end portion
11 Front edge part
13 Locking part
17 Finger hooking part (releasing operation part)
20 Lock engaging part

The invention claimed is:

1. A lock structure of a connector, in which a first connector housing and a second connector housing to be engaged with each other are locked in a releasable manner, the lock structure comprising:

a flexible lock arm, fixed to a wall part of the second connector housing at a base end portion of the flexible lock arm, and extended in a fitting direction in which the second connector housing is fitted with the first connector housing;

a lock engaging part, provided at a distal end portion of the flexible lock arm, and configured to be locked with a locking part provided in the first connector housing; and a releasing lever part, connected to the lock engaging part at one end portion of the releasing lever part, extended along the flexible lock arm, and configured to be rotated together with the lock engaging part around a pivot which is movable while releasing the lock, wherein a thickness of the flexible lock arm is gradually decreased from the base end portion to the lock engaging part.

2. The lock structure of claim 1, wherein the releasing lever part extends side-by-side with the flexible lock arm along the fitting direction.

3. The lock structure of claim 1, wherein the flexible lock arm is provided at an inner portion of the releasing lever lock in a widthwise direction of the lock structure perpendicular from the fitting direction.

4. The lock structure of claim 1, wherein the flexible lock arm and the releasing lever part overlap each other with respect to a plane extending in the fitting direction.

5. The lock structure of claim 1, wherein the lock engaging part protrudes from the flexible lock arm.

6. The lock structure of claim 1, wherein the second connector housing corresponds to a female connector housing and the first connector housing corresponds to a male connector housing.

7. The lock structure of claim 1, wherein the releasing lever part includes a supporting part as a pivot of rotation of the releasing lever part at a time of lock releasing operation, and wherein the supporting part includes a gap between the supporting part and the wall part.

* * * * *